United States Patent [19]

Dubuit

[11] 4,176,598

[45] Dec. 4, 1979

[54] PRINTING MACHINES AND TRANSFER DEVICES THEREFOR

[76] Inventor: Jean-Louis Dubuit, 74 Boulevard Voltaire, 75011 Paris, France

[21] Appl. No.: 842,318

[22] Filed: Oct. 14, 1977

[30] Foreign Application Priority Data

Oct. 20, 1976 [FR] France ..... 76 31497

[51] Int. Cl.[2] ..... B41F 17/22

[52] U.S. Cl. ..... 101/38 A; 74/57; 198/412; 414/737; 414/752

[58] Field of Search ..... 101/38 R, 38 A, 39, 101/40; 198/412, 409; 214/1 BV, 1 BT; 74/57, 58

[56] References Cited

U.S. PATENT DOCUMENTS

| | | | |
|---|---|---|---|
| 230,638 | 8/1880 | King | 214/1 BB X |
| 3,250,213 | 5/1966 | Brigham et al. | 101/40 |
| 3,272,349 | 9/1966 | Rudolph et al. | 214/1 |
| 3,433,346 | 3/1969 | McCaskill | 198/412 X |
| 4,057,149 | 11/1977 | Clarke | 214/1 BV |

FOREIGN PATENT DOCUMENTS

| | | | |
|---|---|---|---|
| 2507166 | 9/1976 | Fed. Rep. of Germany | 198/409 |
| 1583862 | 12/1969 | France | 101/35 |
| 2088579 | 1/1972 | France | 101/38 A |
| 2102899 | 4/1972 | France | 101/35 |
| 2258269 | 8/1975 | France | 101/38 A |

*Primary Examiner*—Clifford D. Crowder
*Attorney, Agent, or Firm*—Charles E. Brown

[57] ABSTRACT

A transfer device for a printing machine transfers an object to be printed, for example a bottle, from a feed conveyor to a printing station. The device comprises a transfer member carried by a sleeve mounted on a shaft, and means for moving the sleeve and thereby the transfer member in a movement which is partially along the shaft and partially rotational about the axis of the shaft. The transfer device may be provided on a machine for printing a succession of objects, comprising a printing station, such as a silk-screen printing station, and a feed conveyor adapted to present the objects to be printed in sequence to the printing station. The transfer device transfers the objects one by one from the feed conveyor to the printing station.

13 Claims, 7 Drawing Figures

PRINTING MACHINES AND TRANSFER DEVICES THEREFOR

BACKGROUND OF THE INVENTION

1. Field of the Invention

The invention relates to the printing of objects, such as bottles, vessels or like objects, of synthetic or other material, and it relates more particularly, but not exclusively, to the printing of an object by a machine comprising at least one printing station of the silk-screen type.

2. Prior Art

It is known for a printing machine having a printing station to be provided with a feed conveyor adapted to present the objects to be printed in succession, and a transfer device adapted to transfer the objects one by one from the feed conveyor to the printing station.

The printing station may be a silk-screen printing station, comprising a silk screen having certain meshes stopped and the others open, so as to constitute the design to be printed, and a squeegee associated with this screen so that movement of the squeegee in relation to the screen compels the ink to pass through the open meshes of the screen and thus to be applied to the object to be printed, which for this purpose is disposed in contact with the screen on the other side thereof in relation to the said squeegee.

For convenience, the silk screen is normally horizontal, in which case the objects to be printed, especially when bottles are concerned, must be presented in a recumbent position directly below the screen. Consequently the feed conveyor may be adapted to transport the objects to be printed, in a recumbent position. However, nowadays feed conveyors are more usually adapted to transport the objects in an upright position, especially when they are flasks, bottles or other similar vessels which are to be filled or are already filled.

In the latter case, it is necessary that between the feed conveyor and the printing station of the printing machine there is interposed a transfer device adapted to move the objects to be printed from their upright position to their recumbent position.

SUMMARY

According to the invention there is provided a transfer device for a printing machine for transferring an object to be printed from a feed conveyor to a printing station, comprising a transfer member carried by a sleeve mounted on a shaft, and means for moving the sleeve and thereby the transfer member in a movement which is partially along the shaft and partially rotational about the axis of the shaft.

Preferably said movement of the shaft and thereby the transfer member partially along the shaft is effected simultaneously with said movement of the sleeve and thereby the transfer member along the shaft. The sleeve and the transfer member are thereby given a screwing movement about the axis of the shaft.

It is admittedly already known to provide a transfer member with a screw-type movement about an axis. However, in arrangements between hitherto the corresponding axis is parallel with the axis of the object at the printing station which means that the transfer member can intervene only between a first conveyor forming the feed conveyor and a second conveyor specifically associated with the printing station.

According to this invention it is preferred that at the printing station there is provided at least one pair of grasping means, such as a base plate and a centre point, at least one of which is mounted for movement towards the other along an axis called the engagement axis, and the transfer axis of the transfer member, i.e. the axis of the shaft, is at right angles to said engagement axis.

It is also preferred that the transfer member of the device according to the invention is a cup equipped with a suction nozzle.

It has admittedly already been proposed to use, as a transfer device of a printing machine, a transfer cup equipped with a suction nozzle and mounted movably between the feed conveyor of such a machine and its printing station, especially in the French Patent registered under No. 70 13914 and published under No. 2,088,579.

However, in such a case the transfer cup is simply mounted on the end of a lever mounted for pivoting about an axis substantially orthogonal to the direction of advance of the feed conveyor, and thus substantially parallel with the axis along which the objects to be printed are gripped, at the printing station, between grasping means for their retention during their printing.

It results from this that the feed conveyor, with the drawbacks mentioned above, must carry the objects to be printed in a recumbent position.

This is not the case with the use of the transfer device according to the invention, as the transfer member is not only movable in rotation about an axis parallel to the direction of advance of the conveyor, but also is movable longitudinally of said axis. Moreover, the transfer device may be used to collect an object for printing in an upright position and to turn it into the recumbent position for its presentation to the printing station. Consequently the transfer device can readily be provided in association with a conveyor adapted to carry the objects to be printed in the upright position. Moreover, this conveyor can be a short conveyor disposed downstream of a conventional feed conveyor or can itself constitute the feed conveyor.

The invention also provides a machine for printing a succession of objects, comprising a printing station, a feed conveyor adapted to present the objects to be printed in sequence to the printing station, and a transfer device adapted to transfer said objects one by one from the feed conveyor to the printing station, the transfer device being as defined above.

DESCRIPTION OF THE PREFERRED EMBODIMENT

Figure 1:
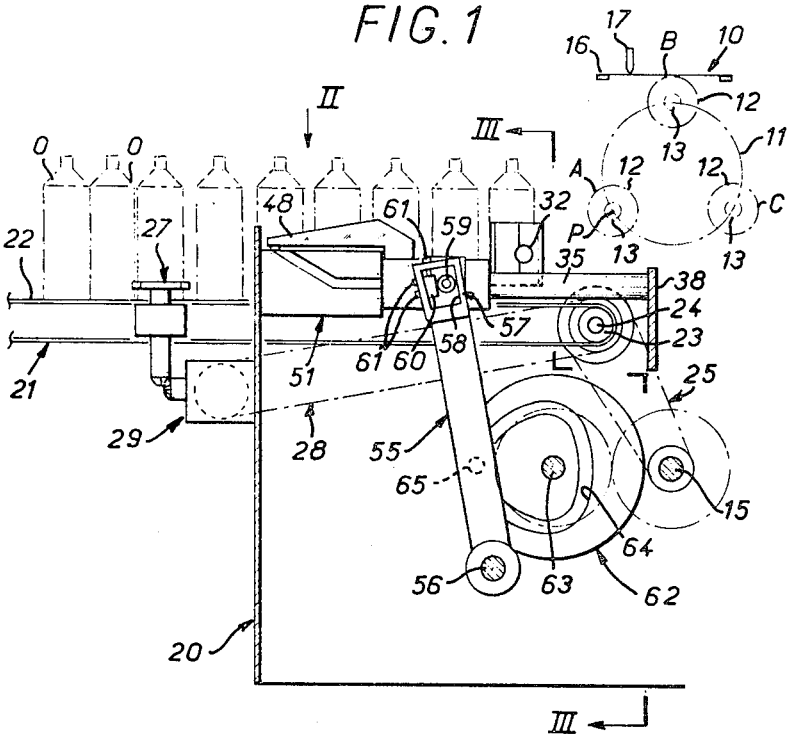
FIG. 1 is a partially sectional elevation, by way of example, of a printing machine equipped with a transfer device according to the invention, along the line I—I in FIG. 2, for the withdrawn position of the transfer device.

As mentioned above, the invention finds particular, but not exclusive, application in the field of printing machines where the printing station is of the silk-screen-type.

Such a printing station has been represented in broken lines at 10 in the drawings.

As a silk-screen printing station is well known per se and is not in itself part of the present invention, it will not be described in detail here.

It will suffice to specify that in this specific example, for the printing of cylindrical objects of circular section, it comprises a drum 11 represented diagrammatically by a simple broken line in FIG. 1 and mounted for rotation about a horizontal shaft.

The drum 11 carries, in regular circular distribution, a plurality of grasping means A, B, C, three in number in this example.

Each pair of grasping means A, B, C comprises a base plate 12 and a centre point 13 spaced therefrom.

The base plate 12 and the centre point 13 of one and the same pair of grasping means are mounted movably horizontally towards one another on the drum 11 carrying them, so that they are capable of gripping and maintaining an object O to be printed, and are subjected to the control of a shaft 15, by means which, being well known per se and not forming part of the present invention, will not be described in detail here.

Figure 2:
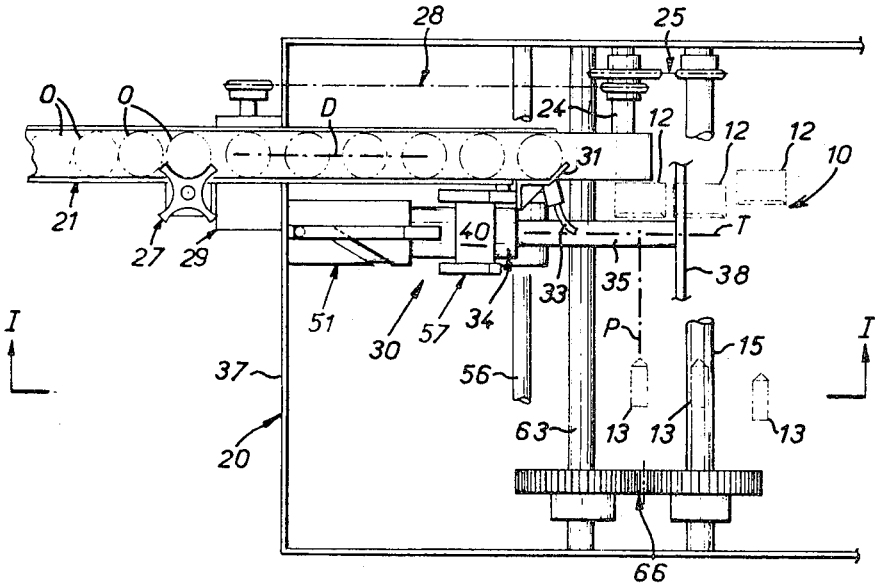
FIG. 2 is a plan view of this machine in the direction of the arrow II in FIG. 1, partially broken away.
Figure 6:
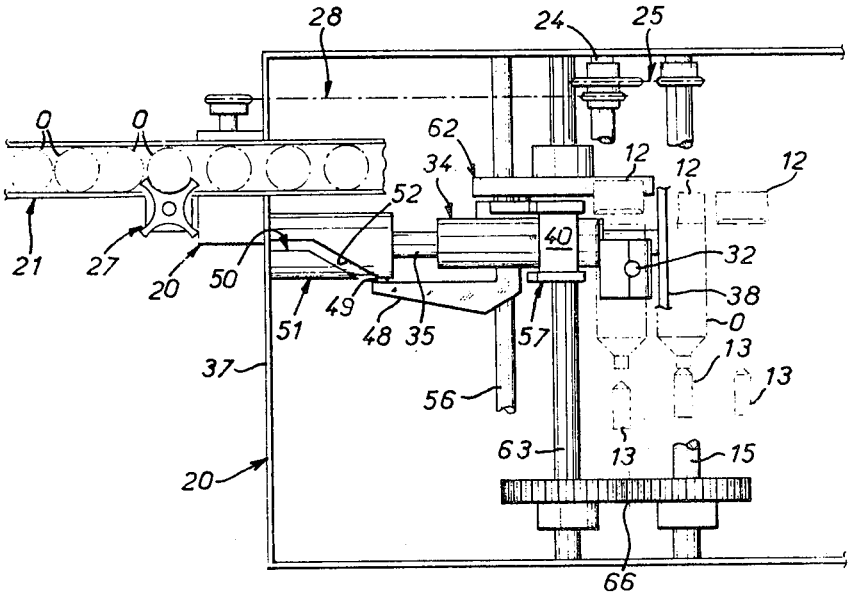

The drum 11 carrying the pairs of grasping means A, B, C is rotatable step by step under the control likewise of known means which are part of the present invention, so that each of the said pairs of grasping means successively occupies a first position, corresponding to the position of the pair A in FIG. 1, in which the base plate 12 and the centre point 3 constituting the pair are first spaced from one another, as in FIG. 6, then brought closer to one another along a horizontal axis P hereinafter called the engagement axis, FIG. 2, for the grasping and then removal of an object O to be printed, a second position corresponding to the position of the pair B in FIG. 1, where the base plate and the centre point constituting the pair maintain the object O to be printed during its printing, FIG. 6, this printing being effected in the usual manner with the aid of a silk screen 16 and a squeegee 17 which are mounted translationally movably in relation to one another, FIG. 1, and a third position corresponding to the position of the pair C in FIG. 1, in which the base plate and centre point constituting the pair release the previously printed object O, FIG. 6, for its discharge.

The printing machine according to the invention, the frame of which has the general reference 20 in the drawings, further comprises a feed conveyor 21 adapted to present the objects O to be printed in succession to the printing station 10.

In this example it is a matter of an ordinary type conveyor comprising a support belt 22 taken in an endless loop over at least two pulleys, one of which, the only one visible in the drawings, is a drive pulley 23 keyed on a shaft 24 and driven by the shaft 15 through a chain and pinion transmission 25.

The feed conveyor 21 is adapted to carry the objects O in the upright position, which objects in this example are bottles.

Guides (not shown) may be associated laterally therewith for correct retention of the objects O which it carries.

In this example the conveyor is further associated with a device adapted to feed the objects O to be printed at a specific rate. This device is a star piece 27 mounted for rotation by the shaft 15 through the intermediary of the transmission 25, the shaft 24, a chain and pinion transmission 28 and a bevel gearing 29, each of the arms of which star piece 27 being inserted in turn between two objects O to be printed, which are carried by the conveyor 21.

These various arrangements are known per se and this is why they have been shown in general in the drawings. Moreover, they need not be further described.

For the printing of each object O, it is necessary to ensure its transfer from the conveyor 21, where it is in the upright position, to the printing station 10, to which it must be presented in the recumbent position, along the engagement axis P specified above.

The transfer device 30 with which the machine according to the invention is equipped for this purpose comprises a transfer member 31 mounted at the same time for translational movement along an axis T, hereinafter called the transfer axis, and for rotational movement about the said transfer axis T.

The transfer axis T is at right angles to the engagement axis P and as the direction of advance D of the conveyor 21 is itself at right angles to the engagement axis P in this example, the transfer axis is itself parallel with this direction of advance D.

In practice, in this example, the transfer member 31 is a cup of dihedral form, and into the middle part of the ridge of this dihedral there opens a suction nozzle 32 which can be seen in FIG. 6 and which, through a tube 33, is connectable to any suction source.

In practice, likewise, the transfer cup 31 is carried by a sleeve 34 mounted for rotation on the one hand on a shaft 35, which extends parallel to the direction of advance D of the conveyor 21 between two struts 37, 38 of the frame 20 and itself constitutes the transfer axis T, and on the other hand in a socket 40 adapted to be displaced along the shaft 35.

Figure 3:
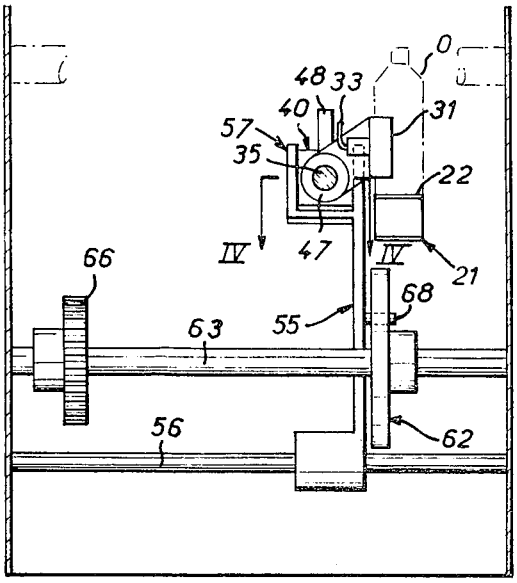
FIG. 3 is an end view and section of this machine, along the broken line III—III in FIG. 1.
Figure 4:
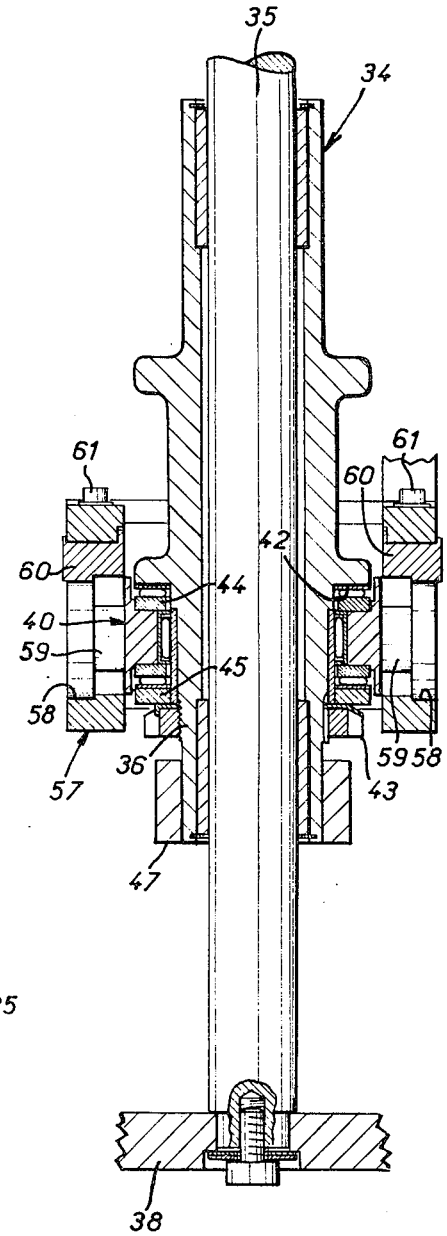
FIG. 4 is a partially sectional view on a different scale of the transfer device with which the machine according to the invention is equipped, along the line IV—IV in FIG. 3.

These arrangements are merely indicated diagrammatically in FIGS. 1 to 3; they appear in greater detail in FIG. 4.

In FIG. 4 it is noted that the hub 36 has a shoulder 42 against which the socket 40 is held by a nut 43 engaged for this purpose on a threaded length of the sleeve 34, bearings 44 and 45 being interposed respectively between the socket 40 and the shoulder 42 of the sleeve 34 on the one hand, and the nut 43 and the socket 40 on the other.

Upon the free extremity of the sleeve 34 there is gripped a split ring 47 which carries the transfer cup 31. At its extremity opposite to that carrying the transfer cup 31, the sleeve 34 is equipped with an arm 48 which extends in over-hanging manner and is itself equipped at its free extremity with a finger 49, in practice surrounded by a roller (not shown), by which it is adapted to cooperate with a guide track 50.

In this example the guide piece 50 is constituted by a groove provided for this purpose in a guide 51 fixed to the frame 20 about the shaft 35, and it comprises a helicoidal portion 52 between two rectilinear end portions substantially parallel with the shaft 35.

The socket 40 in which the sleeve 34 carrying the transfer cup 31 is rotatably mounted is linked to a control lever 55 mounted for pivotal movement about a spindle 56 at right angles to the transfer axis T.

To this end, the lever 55 is equipped at its extremity with a fork joint 57, the two side members of which frame the socket 40, each side member having a slot 58 receiving a respective gudgeon 59 projecting laterally from the socket 40.

In this example, in order that the relative displacement of the fork joint 57 and the gudgeons 59 may take place without play, each gudgeon 59 bears on the one hand upon one of the flanks of the respective slot 58 and on the other upon a wedge 60 on the other flank of this slot, the position of the wedge being adjustable and the wedge being lockable in position by screws 61.

The control lever 55 is actuated by a rotating cam 62 carried by a shaft 63 driven by the shaft 15 through a pinion transmission 66 preferably giving a transmission ratio equal to unity.

In this example the cam 62 has a groove forming a track 64 in which a roller 65 is engaged, the roller being carried by the control lever 55.

Figure 7:
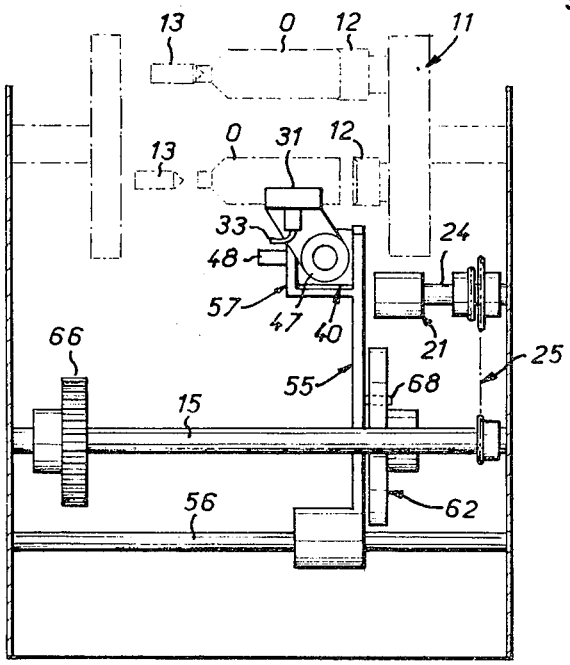
FIGS. 5, 6 and 7 are analogous views respectively with those in FIGS. 1, 2, 3, for the advanced position of the transfer device with which the machine according to the invention is equipped.
Figure 5:
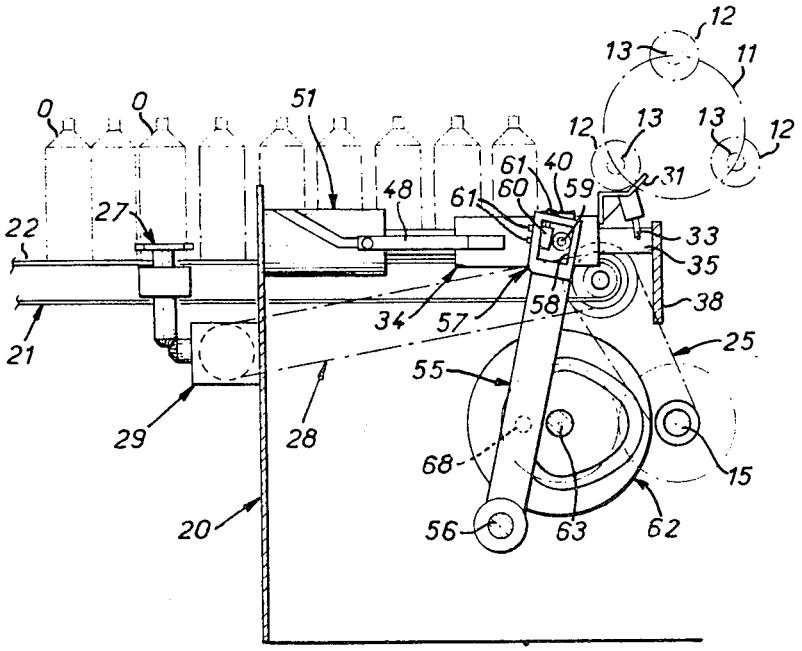

During one revolution of the shaft 15 the control lever 55 drives the sleeve 34 carrying the transfer cup 31 from a withdrawn collecting position, in which as shown in FIGS. 1 and 2 the transfer cup 31 is interposed in the path of the objects O to be printed, carried by the conveyor 21, so that by suction the transfer cup 31 takes from the feed conveyor 21 the leading object to an advanced presentation position in which, as shown in FIGs. 5 to 7, the said transfer cup 31 presents the object O which is previously collected by suction from the conveyor 21 to the printing station 10.

However, between its withdrawn collection position and its advanced presentation position the sleeve 34 carrying the transfer cup 31 has been compelled, by the arm 48 to which it is attached and which is engaged in the associated guide track 50, to pivot through 90° so that the transfer cup 31 presents the object O previously taken from the feed conveyor 21, to the printing station 10 in the recumbent position.

The travel of the sleeve 34 is such that when it is in its advanced presentation position the transfer cup 31 which it carries is situated very exactly in alignment with the engagement axis P of the printing station 10, so that the object O which it carries as shown in FIG. 6 can then be grasped by the pair of grasping means A aligned at that moment with the engagement axis P at the printing station 10.

The object O thus taken over by this pair of grasping means is then conducted, as the drum 11 advances by one step, into line with the screen 16 for the printing, then as the drum 11 advances a further step, it is discharged on to any evacuation or reception means, in accordance with a procedure briefly explained above.

At the same time the control lever 55 returns the sleeve 34 carrying the transfer cup 31 to its withdrawn collection position, in which the said transfer cup is able to collect a fresh object O for printing from the conveyor 21.

The various concerned elements operate in synchronism from the shaft 15 of the machine, the operations as described above being repeated in cycle.

The printing machine described above can reduce the investment costs normally required for the printing of objects such as bottles, and also the number of movements to which these objects are normally subjected for their printing, which movements may damage the objects.

The invention is not restricted to the specific details of the embodiment as described above. For example, it is not imperative that the translational and rotational movements of the sleeve 34 carrying the transfer cup 31 should be conjugated in a screw-type movement; it could, for example, be a matter of distinct successive movements, and more precisely a rotational movement, in practice through 90°, followed by a translational movement.

Moreover, the direction of advance D of the conveyor 21 may be parallel with the engagement axis P.

Furthermore the transfer cup can be reduced to a simple suction nozzle, as described in French Certificate of Addition No. 70 31449 (published under No. 2,102,899) pertaining to French Pat. No. 70 13914 mentioned above, or replaced by any other appropriate transfer member, for example, a transfer member having claws.

I claim:

1. A transfer assembly for a printing machine having a printing station, said transfer assembly comprising a transfer device, a feed conveyor for advancing in upright position objects to be printed in synchronism with said transfer device, said transfer device comprising a fixed shaft, a sleeve mounted for sliding movement along said shaft, a transfer member carried by said sleeve and having a pick-up position intersecting the path of movement of upright objects on said feed conveyor where a moving leading object is picked up by said transfer member in upright position from said feed conveyor, a follower and guide track arrangement coupled to said sleeve for imparting translational movement along said shaft and rotational movement about the axis of said shaft to said sleeve, a selected one of said follower and guide track being fixed relative to said sleeve and the other of said follower and guide track being fixed for movement with respect to said sleeve, whereby in response to the displacement of said sleeve along said shaft said transfer means is rotationally displaced from its pickup position to a drop-off position for introducing in a recumbent position the object carried by said transfer member into said printing station.

2. A transfer assembly according to claim 1, wherein said sleeve is rotatably mounted in a socket adapted to be displaced along the shaft.

3. A transfer assembly according to claim 2, wherein said socket is linked to a control lever mounted for pivotal movement about an axis at right angles to the axis of said shaft.

4. A transfer assembly according to claim 3, including grasping means having means for being mounted at the printing station for receiving an object to be printed from said transfer member, and a cam determining the movement of said control lever, which cam is driven in synchronism with control means for said grasping means.

5. A transfer assembly according to claim 4, wherein said grasping means is movable along an axis into engagement with an object to be printed, said axis of movement of said grasping means being at right angles to the axis of said shaft.

6. The transfer assembly according to claim 1, wherein said transfer member is of fixed cup-shaped configuration to receive a leading object on said feed conveyor in the course of its movement therealong, and suction means in said transfer member for retaining an object being transferred between said pick-up position and said drop-off position.

7. The transfer assembly according to claim 1, wherein the axis of said shaft is parallel to the direction of advance of said feed conveyor.

8. The machine of claim 7 wherein said feed conveyor defines a generally horizontal moving support surface for objects to be printed.

9. A transfer device for a printing machine for transferring an object to be printed from a feed conveyor to a printing station, said transfer device comprising a fixed shaft, a sleeve mounted for sliding movement along said shaft, a transfer member carried by said sleeve, means connected to said sleeve for displacing said sleeve along said shaft from a pick-up position to a drop-off position, an arm fixed to said sleeve for movement therewith, a fixed guide having a guide track cooperable with said arm, said guide track having means for imparting translational movement along said shaft and rotational movement about the shaft axis through said arm to said sleeve to rotationally displace said transfer member about said shaft between said pick-up and drop-off positions.

10. A transfer device according to claim 9; wherein said movement of said sleeve and thereby said transfer member along said shaft is effected simultaneously with said movement of the sleeve and thereby the transfer member rotationally about the axis of said shaft.

11. The transfer assembly according to claim 9, wherein the axis of said shaft is parallel to the direction of advance of said feed conveyor.

12. A machine for printing a succession of objects, said machine comprising a printing station, a feed conveyor for feeding objects in upright position to a transfer device, said transfer device being adapted to transfer one by one objects each in an upright position from said feed conveyor to said printing station in a recumbent position, said transfer device comprising a fixed shaft, a sleeve mounted for sliding movement along said shaft, a transfer member carried by said sleeve and having a pick-up position intersecting the path of movement of upright objects on said feed conveyor where a moving leading object is picked up by said transfer member from said feed conveyor, a follower and guide track arrangement coupled to said sleeve for imparting translational movement along said shaft and rotational movement about the axis of the shaft to said sleeve, a selected one of said sleeve and the other of said follower and guide track being fixed for movement with respect to said sleeve, whereby in response to the displacement of said sleeve along said shaft said transfer member is rotationally displaced about said shaft from its pick-up position to a drop-off position for introducing a picked-up object in a recumbent position at said printing station.

13. The machine according to claim 12, wherein the axis of said shaft is parallel to the direction of advance of said feed conveyor.

* * * * *